US012372266B2

(12) United States Patent
Ji et al.

(10) Patent No.: US 12,372,266 B2
(45) Date of Patent: Jul. 29, 2025

(54) AIR CONDITIONER, AIR CONDITIONER CONTROL METHOD, AND COMPUTER-READABLE STORAGE MEDIUM

(71) Applicant: GD MIDEA AIR-CONDITIONING EQUIPMENT CO., LTD., Guangdong (CN)

(72) Inventors: Ansheng Ji, Guangdong (CN); Guojian Cai, Guangdong (CN); Shunkai Du, Guangdong (CN); Qiwei Liu, Guangdong (CN); Fuxing Zhai, Guangdong (CN); Jian He, Guangdong (CN); Zhengqing Yi, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 425 days.

(21) Appl. No.: 17/876,875

(22) Filed: Jul. 29, 2022

(65) Prior Publication Data

US 2022/0373212 A1 Nov. 24, 2022

Related U.S. Application Data

(63) Continuation of application No. PCT/CN2020/082263, filed on Mar. 31, 2020.

(30) Foreign Application Priority Data

Feb. 26, 2020 (CN) ..... 202010120981.9

(51) Int. Cl.
*F24F 11/79* (2018.01)
*F24F 13/08* (2006.01)
(Continued)

(52) U.S. Cl.
CPC ..... *F24F 11/79* (2018.01); *F24F 13/082* (2013.01); *F24F 13/1413* (2013.01);
(Continued)

(58) Field of Classification Search
CPC ..... F24F 11/79; F24F 13/082; F24F 13/1413; F24F 13/1426; F24F 2013/1446;
(Continued)

(56) References Cited

U.S. PATENT DOCUMENTS

2009/0098815 A1* 4/2009 Hotary ..... F24F 11/30 700/282
2010/0175399 A1* 7/2010 Choi ..... F24F 13/20 62/186
(Continued)

FOREIGN PATENT DOCUMENTS

CN 102889666 A 1/2013
CN 104729001 A 6/2015
(Continued)

OTHER PUBLICATIONS

International Search Report dated Nov. 26, 2020 received in International Application No. PCT/CN2020/082263.
(Continued)

*Primary Examiner* — Michael J Brown
(74) *Attorney, Agent, or Firm* — Scully, Scott, Murphy & Presser, P.C.

(57) ABSTRACT

An air conditioner, a control method and a computer-readable storage medium are provided. The air conditioner has a body provided with an air outlet. An air output assembly suitable for adjusting an air output angle of the air outlet is arranged at the air outlet. The air conditioner further has a detection device for acquiring position information of a target and a controller electrically connected to the air
(Continued)

output assembly and the detection device for controlling the air output assembly according to the position information.

18 Claims, 6 Drawing Sheets

(51) Int. Cl.
*F24F 13/14* (2006.01)
*F24F 11/64* (2018.01)
*F24F 120/12* (2018.01)

(52) U.S. Cl.
CPC .. *F24F 13/1426* (2013.01); *F24F 2013/1446* (2013.01); *F24F 2120/12* (2018.01)

(58) Field of Classification Search
CPC ..... F24F 2120/12; F24F 11/61; F24F 11/64; F24F 1/0011; F24F 13/08; F24F 13/081
USPC ..... 700/277
See application file for complete search history.

(56) References Cited

U.S. PATENT DOCUMENTS

2015/0096318 A1* 4/2015 Matsumoto ..... F24F 11/79 62/190
2016/0137028 A1* 5/2016 Trego ..... B60H 1/00871 165/203

FOREIGN PATENT DOCUMENTS

| | | | |
|---|---|---|---|
| CN | 107631354 | A | 1/2018 |
| CN | 110044043 | A | 7/2019 |
| CN | 110319547 | A | 10/2019 |
| CN | 110319565 | A | 10/2019 |
| CN | 110319569 | A | 10/2019 |
| CN | 210345659 | U | 4/2020 |
| IN | 110701772 | A | 1/2020 |
| JP | H08-28926 | A | 2/1996 |
| JP | 6335425 | B2 | 5/2018 |

OTHER PUBLICATIONS

Supplementary European Search Report dated Jun. 20, 2023 received in European patent Application No. EP 20922448.4.

* cited by examiner

AIR CONDITIONER, AIR CONDITIONER CONTROL METHOD, AND COMPUTER-READABLE STORAGE MEDIUM

CROSS-REFERENCE TO RELATED APPLICATIONS

This application is a continuation application of PCT International Patent Application No. PCT/CN2020/082263, filed on Mar. 31, 2020, which claims priority to and benefits of Chinese Patent Application No. 202010120981.9 filed with China National Intellectual Property Administration on Feb. 26, 2020 and entitled "Air Conditioner, Air Conditioner Control Method, and Computer-Readable Storage Medium", the entire contents of which are herein incorporated by reference for all purposes. No new matter has been introduced.

FIELD

The present disclosure relates to the field of air conditioners, and in particular, to an air conditioner, an air conditioner control method and a computer-readable storage medium.

BACKGROUND

In the related art, in order to avoid directly blowing air to the body of a user, the air conditioner is generally provided with a windless feeling mode. In the windless feeling mode, the room as a whole is in a windless feeling state, resulting in reduced cooling efficiency and inability to meet the user's needs.

SUMMARY

The present disclosure aims to at least solve one of the problems existing in the prior art or related technologies.

To this end, a first aspect of the present disclosure provides an air conditioner.

A second aspect of the present disclosure provides an air conditioner control method.

A third aspect of the present disclosure provides a computer-readable storage medium.

In view of this, the first aspect of the present disclosure provides an air conditioner, comprising: an air conditioner body, provided with an air outlet, and an air output assembly suitable for adjusting an air output angle of the air outlet being arranged at the air outlet; a detection device, configured to be suitable for acquiring position information of a target; and a controller, electrically connected to the air output assembly and the detection device, and controlling the air output assembly according to the position information.

In this embodiment, the air conditioner comprises an air conditioner body, an air outlet is arranged on the air conditioner body, and the air after heat exchange with the indoor heat exchanger is blown out through the air outlet to realize cooling or heating. The air outlet is provided with an air output assembly, and the air output assembly can adjust the air output angle.

In this embodiment, the air conditioner is provided with a detection device, which can detect the position information of the target. The target can be a human body or a preset object, such as "bed", "desk", "sofa" and other furniture where the human body may stay. By controlling the air output assembly to adjust the air output angle according to the position information of the target, so that the direction of the "target" is in a windless feeling state, thereby ensuring that the air supply will not "blow directly" on the human body and improve the comfort of the air conditioner. At the same time, at angles other than the direction of the target, the air supply volume is increased by means of "direct blowing", thereby improving the cooling efficiency under the premise of ensuring that the human body has no need for wind, thereby meeting the various needs of users.

In addition, the air conditioner in the above-mentioned embodiments provided by the present disclosure further have the following additional technical features:

In the above-mentioned embodiment, the air output assembly comprises: a first air deflector arranged inside the air outlet and suitable for swinging relative to an orientation of the air outlet to change the air output angle of the air outlet; and an air diffusing assembly connected to the air conditioner body and suitable for moving relative to the air conditioner body to shield or open the air outlet, the air diffusing assembly being formed with an air diffusing structure, and the air diffusing structure being suitable for allowing an air flow to pass through and diffusing the passing air flow.

In this embodiment, the air output assembly comprises a first air deflector and an air diffusing assembly. Wherein the first air deflector is arranged in the air outlet and can be rotated along an axis perpendicular to the air outlet, thereby changing the air output angle of the air outlet to achieve "left" air supply or "right" air supply. The air diffusing assembly can move relative to the air conditioner body. When the windless feeling mode is not activated, the air diffusing assembly is stored in the air conditioner body. When the windless feeling mode is activated, the air diffusing assembly extends and shields the air outlet. The air diffusing assembly is also provided with an air diffusing structure, through which the air flow passing through the air diffusing assembly can be broken up and made to diffuse and flow, to achieve "windless feeling" and "anti-straight blowing".

In any of the above-mentioned embodiments, the air diffusing structure comprises a first zone and a second zone, the air diffusing structure further comprises: a plurality of wind wheels, wherein the plurality of the wind wheels are arranged and distributed in the first zone and the second zone respectively along a length direction of the air diffusing structure, and the wind wheels in the first zone are meshed and driven by a gear structure, and the wind wheels in the second zone are meshed and driven by a gear structure.

In this embodiment, the air diffusing assembly comprises a first zone and a second zone, respectively corresponding to the left and right sides of the air conditioner. Wherein, the first zone and the second zone are respectively provided with a plurality of wind wheels, the wind wheels are meshed for transmission through a gear structure, and rotated under the driving of a motor to disperse the passing air flow. In practical applications, the wind wheel of the first zone and the wind wheel of the second zone can be independently controlled to satisfy the "left and right" partition air supply.

In any of the above-mentioned embodiments, the wind wheel comprises an inner rib and an outer ring rib, and a first blade and a second blade are arranged between the inner rib and the outer ring rib, blades in the first blade is fixedly connected to the inner rib and the outer ring rib, the second blade is rotationally connected to the inner rib, and the second blade has a first operative position and a second operative position, wherein, the second blade is in the first operative position, and a plurality of blades of the second blade are arranged at intervals with a plurality of blades of the first blade, the second blade is in the second operative position, and blades of the second blade and blades of the first blade are coincident in an axial direction of the wind wheel.

In this embodiment, the wind wheel comprises an inner rib and an outer ring rib, and a first blade and a second blade are set between the inner rib and the outer ring rib. The first blade is a static blade, which is fixedly connected to the outer ring rib and the inner rib. The second blade is a moving blade, and the second blade can rotate around the inner rib and switch between the first operative position and the second operative position.

When the second blade is rotated to the first operative position, the second blade and the first blade are arranged at intervals. At this time, the distribution of blades of the wind wheel is "dense", so the flow velocity of the air flow through the wind wheel is low, and the effect of "windless feeling" is strong. When the second blade is rotated to the second operative position, at least part of the second blade coincides with the first blade. At this time, the distribution of blades of the wind wheel is "sparse", so the flow velocity of the air flow through the wind wheel is relatively high, the effect of "windless feeling" is weak, and the air supply capacity is strong.

In any of the above-mentioned embodiments, the outer ring rib is provided with a positioning portion protruding toward the inner rib, and the second blade is provided with a convex rib corresponding to the positioning portion, the second blade moves to the first operative position, and the positioning portion abuts against the convex rib to limit the second blade.

In this embodiment, the inner ring rib is provided with a protruding positioning portion, and the second blade is provided with a convex rib cooperating with the positioning portion. When controlling the movement of the second blade to switch the position, the position of the second blade is limited by the convex rib and the positioning portion to achieve positioning.

When the air conditioner is shut down and reset, or when the second blade is switched to the first operative position, the second blade is driven to rotate by a motor until the convex rib abuts against the positioning portion, and the motor locks the second blade.

In any of the above-mentioned embodiments, the air conditioner further comprises a communication interface 600 (as shown in FIG. 11), connected to the controller, and configured to receive control instruction; the controller controls the air diffusing assembly to shield the air outlet according to the control instruction, and controls the first air deflector to swing to an initial position.

In this embodiment, after the first air deflector swings to the initial position, the first air deflector guides the wind direction to the front. After the air conditioner is turned on, it runs in the normal cooling or normal heating mode by default, and the windless feeling mode is not activated at this time. When the air conditioner receives the corresponding control instruction through the communication interface, the windless feeling control instruction, the air conditioner enters the default windless feeling state, and controls the air diffusing assembly to shield the air outlet, and controls the first air deflector to swing to the initial position. At this time, the whole room is in a state of windless feeling, which ensures that the human body will not be "directly blown" by the cold wind of the air conditioner to the greatest extent.

In any of the above-mentioned embodiments, determining that the position information is acquired, and the controller controls the air output assembly according to the position information, which can comprise: determining that the position information is located within a range of a first side of the air outlet, and the first air deflector is controlled to swing a preset angle to a second side of the air outlet, to guide the wind of the air outlet toward the first zone of the air diffusing assembly, and control the second blade of the wind wheel in the first zone to move to the second operative position, and control the second blade of the wind wheel in the second zone to move to the first operative position; and determining that the position information is located within a range of a second side of the air outlet, and the first air deflector is controlled to swing the preset angle to a first side of the air outlet, to guide the wind of the air outlet toward the second zone of the air diffusing assembly, and control the second blade of the wind wheel in the second zone to move to the second operative position, and control the second blade of the wind wheel in the first zone to move to the first operative position.

In this embodiment, when the position information is located in the range of the first side of the air outlet, control the first air deflector to swing to the second side of the air outlet, to avoid the wind blowing in the direction of the target. And control the blade in the first zone to rotate to the second operative position to increase the intensity of the windless feeling mode. At the same time, control the second blade of the wind wheel in the second zone to move to the first operative position, that is, to the second zone, that is, increase the air supply volume on one side where the target is not located to improve the cooling effect.

Similarly, when the position information is located in the range of the second side of the air outlet, control the first air deflector to swing to the first side of the air outlet to avoid the wind blowing to the direction of the target. And control the blade in the second zone to rotate to the second operative position to increase the intensity of the windless feeling mode. At the same time, control the second blade of the wind wheel in the first zone to move to the first operative position, that is, to the first zone, that is, increase the air supply volume on one side where the target is not located to improve the cooling effect.

In any of the above-mentioned embodiments, the air conditioner body comprises a casing, the casing has a front side wall, a lower side wall, a left end cover and a right end cover, and a transition position between the front side wall of the casing and the lower side wall of the casing is formed with the air outlet; wherein the first side of the air outlet is close to the left end cover, and the second side of the air outlet is close to the right end cover.

In this embodiment, the casing comprises a front side wall and a lower side wall, corresponding to the front (front direction) and bottom (bottom direction) of the air conditioner, and the air outlet specifically faces the "front and lower" side of the air conditioner. The casing also comprises a left end cover and a right end cover, corresponding to the left and right sides of the air conditioner respectively. Wherein the first side of the air outlet is close to the right end cover, and the second side of the air outlet is close to the left end cover. That is, the first side is the right half of the air outlet, and the second side is the left half of the air outlet. By adjusting the first air deflector to face the left half or the right half, "left and right windless feeling" can be achieved and user experience can be improved.

In some embodiments, the left end cover and the right end cover are respectively provided with side air outlets for lateral air intake.

In any of the above-mentioned embodiments, determining that the position information is located within a range of a first side of the air outlet, and the controller controls the wind wheel in the first zone to run or stand still at a first rotational speed, and at the same time, controls the wind wheel in the second zone to run at a second rotational speed; and determining that the position information is located within a range of a second side of the air outlet, and the controller controls the wind wheel in the second zone to run or stand still at the first rotational speed, and at the same time, controls the wind wheel in the first zone to run at the second rotational speed, wherein the second rotational speed is greater than the first rotational speed.

In this embodiment, according to the position information, correspondingly control the operation of the wind wheel of the first zone and the second zone on the air diffusing assembly. For example, the wind wheel facing the area where the target is located is controlled to run at the first rotational speed or at rest, and the wind wheel facing the area where the non-target is located is controlled to rotate at the second rotational speed. Wherein the first rotational speed is lower than the second rotational speed, that is, the wind speed of the air supply to the direction of the human body is controlled to be low, and the wind speed of the air supply to the direction of the human body is not correspondingly increased. On the basis of ensuring that the air supply will not "blow directly" on the human body and ensure the effect of windless feeling, the cooling effect is improved by increasing the air supply volume in the direction that does not blow directly on the human body to meet the cooling demand.

In any of the above-mentioned embodiments, the preset angle comprises a first preset angle and a second preset angle, the detection device is configured to acquire a first ambient temperature corresponding to a range of a first side of the air outlet and a second ambient temperature corresponding to a range of a second side of the air outlet; determining that the position information is not acquired, and the controller determines a difference value between the first ambient temperature and the second ambient temperature; determining that the difference value is a positive value, and the difference value is within a range of a first preset difference value, and controls the first air deflector to swing the first preset angle to a second side of the air outlet; and controlling the wind wheel in the first zone to rotate at the second rotational speed, and/or controlling the second blade of the wind wheel in the first zone to move to the second operative position; determining that the difference value is a positive value, and the difference value is within a range of a second preset difference, and controls the first air deflector to swing the second preset angle to a second side of the air outlet; and controlling the wind wheel in the first zone to rotate at the first rotational speed, and/or controlling the second blade of the wind wheel in the second zone to move to the first operative position; determining that the difference value is a negative value, and the difference value is within a range of the first preset difference value, and controls the first air deflector to swing the first preset angle to a first side of the air outlet, and controlling the wind wheel in the second zone to rotate at the second rotational speed, and/or controlling the second blade of the wind wheel in the first zone to move to the second operative position; determining that the difference value is a negative value, and the difference value is within a range of the second preset difference value, and controls the first air deflector to swing the second preset angle to a first side of the air outlet; and controlling the wind wheel in the first zone to rotate at the first rotational speed, and/or controlling the second blade of the wind wheel in the first zone to move to the first operative position; and determining that an absolute value of the difference value is within a range of a third preset difference value, and controls the first air deflector to swing to the initial position.

In this embodiment, when the target is not acquired, such as the position information of the human body, according to the first ambient temperature and the second ambient temperature, that is, the temperature difference between the ambient temperature on the left side toward which the air conditioner faces and the ambient temperature on the right side toward which the air conditioner faces controls the air output assembly to change the air output direction.

For example, the difference value of the first ambient temperature and the second ambient temperature is a positive value, it means that the left and right temperatures in the room are uneven, and the temperature on the left side is higher than the temperature on the right side. At this time, the temperature difference range is further acquired. If the temperature difference range is within the range of the first difference value, it means that the temperature difference is large. At this time, control the first air deflector to rotate to the left side by a larger first preset angle, and control the wind wheel in the first zone to rotate at second rotational speed. It can also control the second blade of the wind wheel in the first zone to move to the second operative position at the same time, send more cold air to the left room with a larger air volume, and enhance the cooling effect to the left side of the room with a larger force.

If the temperature difference range is within the range of the second difference value, it means that the temperature difference is small. At this time, control the first air deflector to rotate to the left side by a smaller second preset angle, and control the wind wheel in the first zone to rotate at the first rotational speed. The second blade of the wind wheel in the first zone also can be controlled to move to the first operative position at the same time, send more cold air to the left room with a smaller air volume, and increase the cooling effect to the left side of the room with a smaller force.

When the difference value between the first ambient temperature and the second ambient temperature is a positive value, it means that the temperature on the left side of the room is higher than the temperature on the right side, and the temperature difference range is further acquired at this time. If the temperature difference range is within the range of the first difference value, it means that the temperature difference is large. At this time, the first air deflector is controlled to rotate to the right side by a larger first preset angle, and the wind wheel in the second zone rotates at the second rotational speed. It can also control the second blade of the wind wheel in the second zone to move to the second operative position, to send more cold air to the right room with a larger air volume, and enhance the cooling effect to the right side of the room with a larger force.

If the temperature difference is within the range of second difference value, it means that the temperature difference is small. At this time, control the first air deflector to rotate to the right side by a smaller second preset angle, and control the wind wheel in the second zone to rotate at first rotational speed. It can also control the second blade of the wind wheel in the second zone to move to the first operative position at the same time, to send more cold air to the right room with a smaller air volume, and enhance the cooling effect to the right side of the room with a smaller force.

When the absolute values of the first ambient temperature and the third ambient temperature are within the third preset difference value range. It can be considered that the temperature in the room is uniform from left to right, control the first air deflector to swing to the initial position, and the air is normally supplied to the front of the room.

In any of the above-mentioned embodiments, the air conditioner further comprises a second air deflector, rotatably connected to the air conditioner body, and configured to open or close the air outlet, and the second air deflector is provided with a through hole for air flow to pass through, the second air deflector and the air diffusing assembly are assembled to define an angle-shaped cavity located outside the air outlet of the air conditioner and communicated with the air outlet of the air conditioner, and both ends of the cavity along a length direction of a splicing line of the second air deflector and the air diffusing assembly are respectively formed with a side opening, and the side opening communicates with the cavity.

In this embodiment, the second air deflector is used to open or close the air outlet. For example, when the air conditioner is turned off, the second air deflector covers the air guide outlet. After the air conditioner is turned on, the second air deflector rotates relative to the air conditioner body and opens the air outlet. At the same time, the second air deflector is provided with a plurality of through holes, and the air flow will be broken up into multiple staggered small air flows after passing through the through holes.

After the second air deflector is assembled with the air diffusing assembly, a cavity is formed outside the air outlet, and side openings are formed on both sides of the cavity, thereby realizing air supply on both sides. In some embodiments, a side fan may also be provided at the side opening to ensure the air supply volume of the side air supply.

In any of the above-mentioned embodiments, the detection device comprises at least one of the following: a temperature sensor, an infrared distance detection device, an image recognition device, a radar position detection device, and a smart wearable device.

In this embodiment, the detection device can detect the distance of the target, as well as the ambient temperature. For example, the detection device comprises a temperature sensor capable of detecting ambient temperature. When detecting the distance of the target, the distance value can be detected through the infrared distance detection device, or the image information in front of the air conditioner can be captured. The position of the target is determined by the image recognition device, and the distance value is further determined. It is also possible to detect the distance of the target through the radar position detection device, or report the position information of the target through the smart wearable device, and calculate the corresponding distance value.

The second aspect of the present disclosure provides an air conditioner control method for controlling the air conditioner provided in any of the above-mentioned embodiments, the control method comprises: acquiring, position information of a target; controlling, the air output assembly of the air conditioner according to the position information to adjust the air output angle of the air outlet of the air conditioner.

In this embodiment, the air conditioner comprises an air output assembly, and the air output assembly can adjust the air output angle.

For example, the position information of the target is detected, and the target may be a human body or a preset object, such as "bed", "desk", "sofa" and other furniture where the human body may stay. By controlling the air output assembly to adjust the air output angle according to the position information of the target, so that the direction of the "target" is in a windless feeling state, thereby ensuring that the air supply will not "blow directly" on the human body and improve the comfort of the air conditioner. At the same time, at angles other than the direction of the target, the air supply volume is increased by means of "direct blowing", thereby improving the cooling efficiency under the premise of ensuring that the human body has no need for wind, thereby meeting the various needs of users.

In the above-mentioned embodiment, the air output assembly comprises an air diffusing assembly and a first air deflector, the control method also comprises: receiving, a control instruction, and controlling the air diffusing assembly to shield the air outlet according to the control instruction, and controlling the first air deflector to swing to an initial position.

In this embodiment, after the air conditioner is turned on, it runs in the normal cooling or normal heating mode by default, and the windless feeling mode is not activated at this time. When the air conditioner receives the corresponding control instruction, the windless feeling control instruction, through the communication interface, the air conditioner enters the default windless feeling state. And control the air diffusing assembly to shield the air outlet, and at the same time, control the first air deflector to swing to the initial position. At this time, the whole room is in a windless feeling state, which ensures that the human body will not be "directly blown" by the cold wind of the air conditioner to the greatest extent.

In any of the above-mentioned embodiments, the step of determining position information is acquired, and controlling the air output assembly of the air conditioner according to the position information can comprise: determining the position information is located within a range of a first side of the air outlet, and the first air deflector is controlled to swing a preset angle to a second side of the air outlet, to guide the wind of the air outlet toward the first zone of the air diffusing assembly, and control a second blade of an wind wheel in the first zone to move to a second operative position, and control the second blade of the wind wheel in a second zone of the air diffusing assembly to move to a first operative position; and determining the position information is located within a range of a second side of the air outlet, and the first air deflector is controlled to swing the preset angle to a first side of the air outlet, to guide the wind of the air outlet toward the second zone of the air diffusing assembly, and control the second blade of the wind wheel in the second zone to move to the second operative position, and control the second blade of the wind wheel in the first zone to move to the first operative position.

In this embodiment, when the position information is located in the range of the first side of the air outlet, control the first air deflector to swing to the second side of the air outlet, to avoid the wind blowing in the direction of the target. And control the blade in the first zone to rotate to the second operative position to increase the intensity of the windless feeling mode. At the same time, control the second blade of the wind wheel in the second zone to move to the first operative position, that is, to the second zone, that is, increase the air supply volume on one side where the target is not located to improve the cooling effect.

Similarly, when the position information is located in the range of the second side of the air outlet, control the first air deflector to swing to the first side of the air outlet to avoid the wind blowing to the direction of the target. And control the blade in the second zone to rotate to the second operative position to increase the intensity of the windless feeling mode. At the same time, control the second blade of the wind wheel in the first zone to move to the first operative position, that is, to the first zone, that is, increase the air supply volume on one side where the target is not located to improve the cooling effect.

In any of the above-mentioned embodiments, the air conditioner control method further comprises determining the position information is located within a range of a first side of the air outlet, and controlling the wind wheel in the first zone to run at a first rotational speed, and at the same time, controlling the wind wheel in the second zone to run at a second rotational speed; and determining the position information is located within a range of a second side of the air outlet, and controlling the wind wheel in the second zone to run at the first rotational speed, and at the same time, controlling the wind wheel in the first zone to run at the second rotational speed, wherein, the second rotational speed is greater than the first rotational speed.

In this embodiment, according to the position information, correspondingly control the operation of the wind wheel of the first zone and the second zone on the air diffusing assembly. For example, the wind rotor facing the area where the target is located is controlled to run at the first rotational speed, and the wind wheel facing the area where the non-target is located is controlled to rotate at the second rotational speed. Wherein the first rotational speed is lower than the second rotational speed, that is, the wind speed of the air supply to the direction of the human body is controlled to be low, and the wind speed of the air supply to the direction of the human body is not correspondingly increased. On the basis of ensuring that the air supply will not "blow directly" on the human body and ensure the effect of windless feeling, the cooling effect is improved by increasing the air supply volume in the direction that does not blow directly on the human body to meet the cooling demand.

In any of the above-mentioned embodiments, the preset angle comprises a first preset angle and a second preset angle, the control method further comprising: acquiring a first ambient temperature corresponding to a range of a first side of the air outlet and a second ambient temperature corresponding to a range of a second side of the air outlet; determining the position information is not acquired, and determining a difference value between the first ambient temperature and the second ambient temperature; determining the difference value is a positive value, and the difference value is within a range of a first preset difference value, and controlling the first air deflector to swing the first preset angle to a second side of the air outlet; and controlling a wind wheel in a first zone of the air diffusing assembly to rotate at the second rotational speed, and/or controlling the second blade of the wind wheel in the first zone to move to the second operative position; determining the difference value is a positive value, and the difference value is within a range of a second preset difference, and controlling the first air deflector to swing the second preset angle to a second side of the air outlet; and controlling the wind wheel in the first zone to rotate at the first rotational speed, and/or controlling the second blade of the wind wheel in the second zone of the air diffusing assembly to move to the first operative position; determining the difference value is a negative value, and the difference value is within a range of the first preset difference value, and controlling the first air deflector to swing the first preset angle to a first side of the air outlet, and controlling the wind wheel in the second zone to rotate at the second rotational speed, and/or controlling the second blade of the wind wheel in the first zone to move to the second operative position; determining the difference value is a negative value, and the difference value is within a range of the second preset difference value, and controlling the first air deflector to swing the second preset angle to a first side of the air outlet; and controlling the wind wheel in the first zone to rotate at the first rotational speed, and/or controlling the second blade of the wind wheel in the first zone to move to the first operative position; and determining an absolute value of the difference value is within a range of a third preset difference value, and controlling the first air deflector to swing to the initial position.

In this embodiment, when the target is not acquired, such as the position information of the human body, according to the first ambient temperature and the second ambient temperature, that is, the temperature difference between the ambient temperature on the left side toward which the air conditioner faces and the ambient temperature on the right side toward which the air conditioner faces controls the air output assembly to change the air output direction.

The difference value of the first ambient temperature and the second ambient temperature is a positive value, it means that the left and right temperatures in the room are uneven, and the temperature on the left side is higher than the temperature on the right side. At this time, the temperature difference range is further acquired. If the temperature difference range is within the range of the first difference value, it means that the temperature difference is large. At this time, control the first air deflector to rotate to the left side by a larger first preset angle, and control the wind wheel in the first zone to rotate at second rotational speed. It can also control the second blade of the wind wheel in the first zone to move to the second operative position at the same time, send more cold air to the left room with a larger air volume, and enhance the cooling effect to the left side of the room with a larger force.

If the temperature difference range is within the range of the second difference value, it means that the temperature difference is small. At this time, control the first air deflector to rotate to the left side by a smaller second preset angle, and control the wind wheel in the first zone to rotate at the first rotational speed. The second blade of the wind wheel in the first zone also can be controlled to move to the first operative position at the same time, send more cold air to the left room with a smaller air volume, and increase the cooling effect to the left side of the room with a smaller force.

When the difference value between the first ambient temperature and the second ambient temperature is a positive value, it means that the temperature on the left side of the room is higher than the temperature on the right side, and the temperature difference range is further acquired at this time. If the temperature difference range is within the range of the first difference value, it means that the temperature difference is large. At this time, control the first air deflector to rotate to the right side with a larger first preset angle, and the wind wheel in the second zone rotates at the second rotational speed. It can also control the second blade of the wind wheel in the second zone to move to the second operative position at the same time, send more cold air to the right room with a larger air volume, and enhance the cooling effect to the right side of the room with a larger force.

If the temperature difference is within the range of the second difference value, it means that the temperature difference is small. At this time, control the first air deflector to rotate to the right by a smaller second preset angle, and control the wind wheel in the second zone to rotate at first rotational speed. The second blade of the wind wheel in the second zone also can be controlled to move to the first operative position at the same time, to send more cold air to the right room with a smaller air volume, and to enhance the cooling effect to the right side of the room with a smaller force.

When the absolute value of the first ambient temperature and the third ambient temperature is within the range of the third preset difference value, it can be considered that the left and right temperatures in the room are uniform, and the first air deflector is controlled to swing to the initial position, and wind normally to the front of the room.

In any of the above-mentioned embodiments, a range of the first preset difference value is less than or equal to 5 and greater than or equal to 2, a range of the second preset difference value is less than or equal to 2 and greater than or equal to 1, a range of the third preset difference value is greater than or equal to 0 and less than 1.

It can be understood that the first preset difference value range, the second preset difference value range and the third preset difference value range can be adjusted correspondingly according to the specific environmental conditions or the installation of the air conditioner and the actual needs of users. The preset ranges in the embodiments of the present disclosure are not limited to the above-mentioned numerical ranges.

In any of the above-mentioned embodiments, the air conditioner control method further comprises recording duration information of the first air deflector at any angle, and generating historical angle record according to the duration information; and determining a power-on instruction is received, and determining an initial angle according to the historical angle record, and controlling the first air deflector to swing to the initial angle.

In this embodiment, the duration information of the first air deflector at different angles is recorded, and a historical angle record is generated. According to the historical angle record, the angle data most frequently used by the user can be acquired. When the air conditioner is turned on again, the angle with the longest use time by the user is taken as the initial angle by default, and the first air deflector is controlled to work at the initial angle, which can ensure that the wind mode of the air conditioner matches the user's usage habits to the greatest extent, and improve the user experience.

A third aspect of the present disclosure provides a computer-readable storage medium on which a computer program is stored, and when the computer program is executed by a processor, implements the air conditioner control method provided in any of the above-mentioned embodiments. Therefore, the computer-readable storage medium comprises all the beneficial effects of the air conditioner control method provided in any of the above-mentioned embodiments, and will not be repeated here.

BRIEF DESCRIPTION OF THE DRAWINGS

Additional aspects and advantages of the present disclosure will become apparent in the following description or will be learned by practice of the present disclosure.

Figure 1:
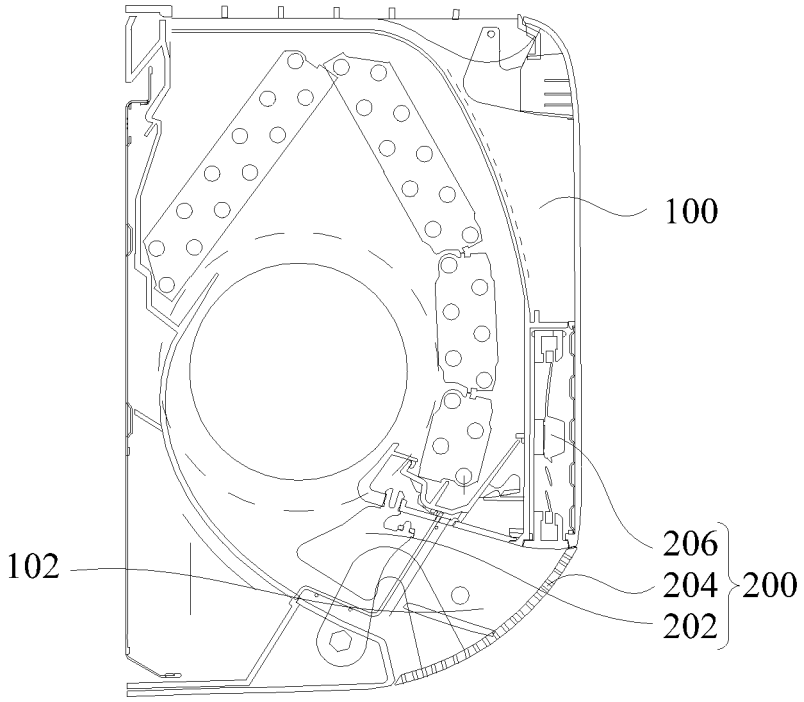
FIG. 1 shows a structural schematic diagram of an air conditioner according to an embodiment of the present disclosure.

The corresponding relationship between the reference signs and component names in FIG. 1 to FIG. 11 is as follows:

100 air conditioner body, 102 air outlet, 200 air output assembly, 202 first air deflector, 204 second air deflector, 206 air diffusing assembly, 300 wind wheel, 302 inner rib, 304 outer ring rib, 306 first blade, 308 second blade, 400 detection device, 500 controller, communication interface 600.

DETAILED DESCRIPTION OF THE DISCLOSURE

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

The air conditioner, the air conditioner control method and the computer-readable storage medium according to some embodiments of the present disclosure are described below with reference to FIG. 1 to FIG. 11.

As shown in FIG. 1, FIG. 2, FIG. 3 and FIG. 11, in an embodiment of the first aspect of the present disclosure, an air conditioner is provided, comprising: an air conditioner body 100, provided with an air outlet 102, and the air output assembly 200 suitable for adjusting an air output angle of the air outlet 102 being arranged at the air outlet 102; a detection device 400, configured to be suitable for acquiring position information of a target; and a controller 500, electrically connected to the air output assembly 200 and the detection device, and controlling the air output assembly 200 according to the position information.

The detection device comprises at least one of the following: a temperature sensor, an infrared distance detection device, an image recognition device, a radar position detection device, and a smart wearable device.

In this embodiment, the air conditioner comprises an air conditioner body 100, an air outlet 102 is arranged on the air conditioner body 100, and the air after heat exchange with the indoor heat exchanger is blown out through the air outlet 102 to realize cooling or heating. The air outlet 102 is provided with an air output assembly 200, and the air output assembly 200 can adjust the air output angle.

The air conditioner is provided with a detection device, which can detect the position information of the target. The target can be a human body or a preset object, such as "bed", "desk", "sofa" and other furniture where the human body may stay. By controlling the air output assembly 200 to adjust the air output angle according to the position information of the target, so that the direction of the "target" is in a windless feeling state, thereby ensuring that the air supply will not "blow directly" on the human body and improve the comfort of the air conditioner. At the same time, at angles other than the direction of the target, the air supply volume is increased by means of "direct blowing", thereby improving the cooling efficiency under the premise of ensuring that the human body has no need for wind, thereby meeting the various needs of users.

In this disclosure, "windless feeling" is defined as follows: within the range of 2.5 meters to 3 meters from the air outlet of the air conditioner, the average wind speed is lower than 0.1 m/s, or when the distance from the air outlet is 2.5 meters and below, when the DR value (air output ratio) is in the range of 5 to 20, it is considered as "windless feeling" at this time.

The detection device can detect the distance of the target, as well as the ambient temperature. The detection device comprises a temperature sensor capable of detecting ambient temperature. When detecting the distance of the target, the distance value can be detected through the infrared distance detection device, or the image information in front of the air conditioner can be captured. The position of the target is determined by the image recognition device, and the distance value is further determined. It is also possible to detect the distance of the target through the radar position detection device, or report the position information of the target through the smart wearable device, and calculate the corresponding distance value.

Figure 2:
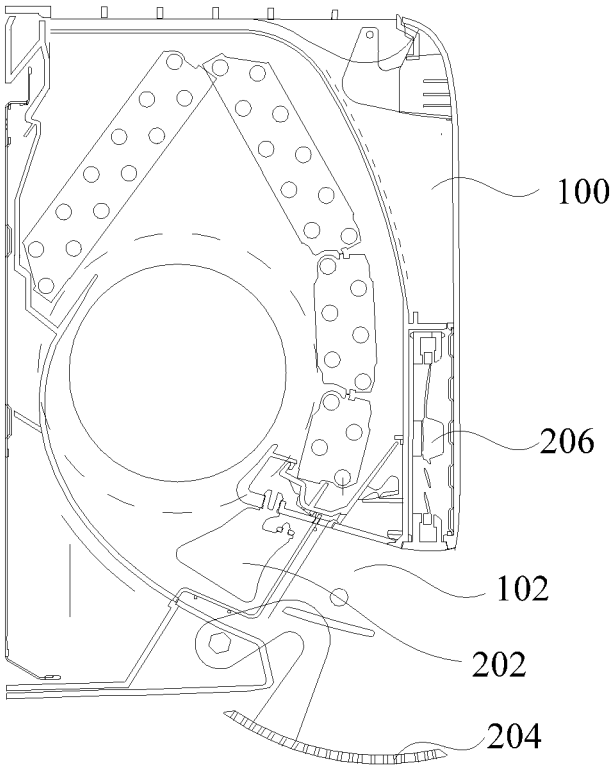
FIG. 2 shows another structural schematic diagram of the air conditioner.
Figure 3:
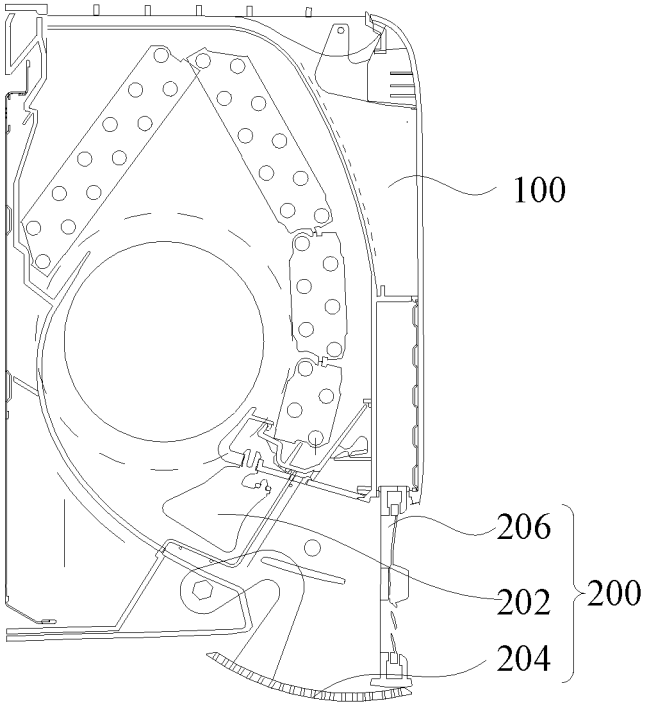
FIG. 3 shows yet another structural schematic diagram of the air conditioner.

As shown in FIG. 1, FIG. 2 and FIG. 3, in one embodiment of the present disclosure, the air output assembly 200 comprises: a first air deflector 202 arranged inside the air outlet 102 and suitable for swinging relative to an orientation of the air outlet 102 to change the air output angle of the air outlet 102; and an air diffusing assembly 206 connected to the air conditioner body 100 and suitable for moving relative to the air conditioner body 100 to shield or open the air outlet 102, the air diffusing assembly 206 being formed with an air diffusing structure, and the air diffusing structure being suitable for allowing air flow to pass through and diffusing the passing air flow.

The air diffusing structure comprises a first zone and a second zone, the air diffusing structure further comprises: a plurality of wind wheels 300. The plurality of the wind wheels 300 are arranged and distributed in the first zone and the second zone respectively along a length direction of the air diffusing structure, and the wind wheels 300 in the first zone are meshed and driven by a gear structure, and the wind wheels 300 in the second zone are meshed and driven by a gear structure.

Figure 4:
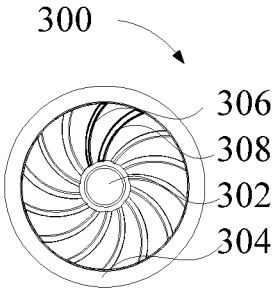
FIG. 4 shows a schematic diagram of a second blade in a first operative position in an wind wheel of the air conditioner.
Figure 5:
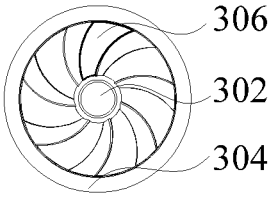
FIG. 5 shows a schematic diagram of the second blade in a second operative position.

As shown in FIG. 4 and FIG. 5, the wind wheel 300 comprises an inner rib 302 and an outer ring rib 304, and a first blade 306 and a second blade 308 are set between the inner rib 302 and the outer ring rib 304. The blade in the first blade 306 is fixedly connected to the inner rib 302 and the outer ring rib 304, and the second blade 308 is rotatably connected to the inner rib 302. And the second blade 308 has a first operative position and a second operative position. When the second blade 308 is in the first operative position, the multiple blades of the second blade 308 and the multiple blades of the first blade 306 are arranged at intervals. When the second blade 308 is in the second operative position, the blade of the second blade 308 overlaps the blade of the first blade 306 in the axial direction of the wind wheel 300.

The outer ring rib 304 is provided with a positioning portion protruding toward the inner rib 302, and the second blade 308 is provided with a convex rib corresponding to the positioning portion, the second blade 308 moves to the first operative position, and the positioning portion abuts against the convex rib to limit the second blade 308.

In this embodiment, the air output assembly 200 comprises a first air deflector 202 and an air diffusing assembly 206. The first air deflector 202 is arranged in the air outlet 102 and can be rotated along an axis perpendicular to the air outlet 102, thereby changing the air output angle of the air outlet 102 to achieve "left" air supply or "right" air supply. The air diffusing assembly 206 can move relative to the air conditioner body 100. When the windless feeling mode is not activated, the air diffusing assembly 206 is stored in the air conditioner body 100. When the windless feeling mode is activated, the air diffusing assembly 206 extends and shields the air outlet 102. The air diffusing assembly 206 is also provided with an air diffusing structure, through which the air flow passing through the air diffusing assembly 206 can be broken up and made to diffuse and flow, to achieve "windless feeling" and "anti-straight blowing".

The air diffusing assembly 206 comprises a first zone and a second zone, respectively corresponding to the left and right sides of the air conditioner. The first zone and the second zone are respectively provided with a plurality of wind wheels 300, the wind wheels 300 are meshed for transmission through a gear structure, and rotated under the driving of a motor to disperse the passing air flow. In practical applications, the wind wheel 300 of the first zone and the wind wheel 300 of the second zone can be independently controlled to satisfy the "left and right" partition air supply.

The wind wheel 300 comprises an inner rib 302 and an outer ring rib 304, and a first blade 306 and a second blade 308 are set between the inner rib 302 and the outer ring rib 304. The first blade 306 is a static blade, which is fixedly connected to the outer ring rib 304 and the inner rib 302. The second blade 308 is a moving blade, and the second blade 308 can rotate around the inner rib 302 and switch between the first operative position and the second operative position.

When the second blade 308 is rotated to the first operative position, the second blade 308 and the first blade 306 are arranged at intervals. At this time, the distribution of blades of the wind wheel 300 is "dense", so the flow velocity of the air flow through the wind wheel 300 is low, and the effect of "windless feeling" is strong. When the second blade 308 is rotated to the second operative position, at least part of the second blade 308 overlaps the first blade 306. At this time, the distribution of blades of the wind wheel 300 is "sparse", so the flow velocity of the air flow through the wind wheel 300 is relatively high, the effect of "windless feeling" is weak, and the air supply capacity is strong.

The inner ring rib is provided with a protruding positioning portion, and the second blade 308 is provided with a convex rib cooperating with the positioning portion. When controlling the movement of the second blade 308 to switch the position, the position of the second blade 308 is limited by the convex rib and the positioning portion to achieve positioning.

When the air conditioner is shut down and reset, or when the second blade 308 is switched to the first operative position, the second blade 308 is driven to rotate by a motor until the convex rib abuts against the positioning portion, and the motor locks the second blade 308.

The motor driving the second blade 308 may be a stepper motor and the position of the second blade 308 is adjusted by controlling the rotation of the stepper motor by a fixed number of steps.

As shown in FIG. 1, FIG. 2 and FIG. 3, in one embodiment of the present disclosure, the air conditioner further comprises a communication interface, connected to the controller, and configured to receive control instruction; the controller controls the air diffusing assembly 206 to shield the air outlet 102 according to the control instruction, and controls the first air deflector 202 to swing to an initial position.

Determining that position information is acquired, and the controller controls the air output assembly 200 according to the position information, which can comprise: determining that the position information is located within a range of a first side of the air outlet 102, and the first air deflector 202 is controlled to swing a preset angle to a second side of the air outlet 102, to guide the wind of the air outlet 102 toward the first zone of the air diffusing assembly 206, and control the second blade 308 of the wind wheel 300 in the first zone to move to the second operative position, and control the second blade 308 of the wind wheel 300 in the second zone to move to the first operative position; and determining that the position information is located within a range of a second side of the air outlet 102, and the first air deflector 202 is controlled to swing the preset angle to a first side of the air outlet 102, to guide the wind of the air outlet 102 toward the second zone of the air diffusing assembly 206, and control the second blade 308 of the wind wheel 300 in the second zone to move to the second operative position, and control the second blade 308 of the wind wheel 300 in the first zone to move to the first operative position.

Determining that the position information is located within a range of a first side of the air outlet 102, and the controller controls the wind wheel 300 in the first zone to run or stand still at a first rotational speed, and at the same time, controls the wind wheel 300 in the second zone to run at a second rotational speed; determining that the position information is located within a range of a second side of the air outlet 102, and the controller controls the wind wheel 300 in the second zone to run or stand still at the first rotational speed, and at the same time, controls the wind wheel 300 in the first zone to run at the second rotational speed; the second rotational speed is greater than the first rotational speed.

In this embodiment, after the first air deflector 202 swings to the initial position, the first air deflector 202 guides the wind direction to the front. After the air conditioner is turned on, it runs in the normal cooling or normal heating mode by default, and the windless feeling mode is not activated at this time. When the air conditioner receives the corresponding control instruction through the communication interface, the windless feeling control instruction, the air conditioner enters the default windless feeling state, and controls the air diffusing assembly 206 to shield the air outlet 102, and controls the first air deflector 202 to swing to the initial position. At this time, the whole room is in a windless feeling state, which ensures that the human body will not be "directly blown" by the cold wind of the air conditioner to the greatest extent.

When the position information is located in the range of the first side of the air outlet 102, control the first air deflector 202 to swing to the second side of the air outlet 102, to avoid the wind blowing in the direction of the target. And control the blade in the first zone to rotate to the second operative position to increase the intensity of the windless feeling mode. At the same time, control the second blade 308 of the wind wheel 300 in the second zone to move to the first operative position, that is, to the second zone, that is, increase the air supply volume on one side where the target is not located to improve the cooling effect.

Similarly, when the position information is located in the range of the second side of the air outlet 102, control the first air deflector 202 to swing to the first side of the air outlet 102 to avoid the wind blowing to the direction of the target. And control the blade in the second zone to rotate to the second operative position to increase the intensity of the windless feeling mode. At the same time, control the second blade 308 of the wind wheel 300 in the first zone to move to the first operative position, that is, to the first zone, that is, increase the air supply volume on one side where the target is not located to improve the cooling effect.

According to the position information, correspondingly control the operation of the wind wheel 300 of the first zone and the second zone on the air diffusing assembly 206. For example, the wind wheel 300 facing the area where the target is located is controlled to run at the first rotational speed or at rest, and the wind wheel 300 facing the area where the non-target is located is controlled to rotate at the second rotational speed. The first rotational speed is lower than the second rotational speed, that is, the wind speed of the air supply to the direction of the human body is controlled to be low, and the wind speed of the air supply to the direction of the human body is not correspondingly increased. On the basis of ensuring that the air supply will not "blow directly" on the human body and ensure the effect of windless feeling, the cooling effect is improved by increasing the air supply volume in the direction that does not blow directly on the human body to meet the cooling demand.

As shown in FIG. 1, FIG. 2 and FIG. 3, in one embodiment of the present disclosure, the preset angle comprises a first preset angle and a second preset angle, the detection device is configured to acquire a first ambient temperature corresponding to a range of a first side of the air outlet 102 and a second ambient temperature corresponding to a range of a second side of the air outlet 102; determining that the position information is not acquired, and the controller determines a difference value between the first ambient temperature and the second ambient temperature; determining that the difference value is a positive value, and the difference value is within a range of a first preset difference value, and controls the first air deflector 202 to swing the first preset angle to a second side of the air outlet; and controlling the wind wheel 300 in the first zone to rotate at the second rotational speed, and/or controlling the second blade 308 of the wind wheel 300 in the first zone to move to the second operative position; determining that the difference value is a positive value, and the difference value is within a range of a second preset difference, and controls the first air deflector 202 to swing the second preset angle to a second side of the air outlet; and controlling the wind wheel 300 in the first zone to rotate at the first rotational speed, and/or controlling the second blade 308 of the wind wheel 300 in the second zone to move to the first operative position; determining that the difference value is a negative value, and the difference value is within a range of the first preset difference value, and controls the first air deflector 202 to swing the first preset angle to a first side of the air outlet, and controlling the wind wheel 300 in the second zone to rotate at the second rotational speed, and/or controlling the second blade 308 of the wind wheel 300 in the first zone to move to the second operative position; determining that the difference value is a negative value, and the difference value is within a range of the second preset difference value, and controls the first air deflector 202 to swing the second preset angle to a first side of the air outlet; and controlling the wind wheel 300 in the first zone to rotate at the first rotational speed, and/or controlling the second blade 308 of the wind wheel 300 in the first zone to move to the first operative position; determining that an absolute value of the difference value is within a range of a third preset difference value, and controls the first air deflector 202 to swing to the initial position.

In this embodiment, when the target is not acquired, such as the position information of the human body, according to the first ambient temperature and the second ambient temperature, that is, the temperature difference between the ambient temperature on the left side toward which the air conditioner faces and the ambient temperature on the right side toward which the air conditioner faces controls the air output assembly to change the air output direction.

The difference value of the first ambient temperature and the second ambient temperature is a positive value, it means that the left and right temperatures in the room are uneven, and the temperature on the left side is higher than the temperature on the right side. At this time, the temperature difference range is further acquired. If the temperature difference range is within the range of the first difference value, it means that the temperature difference is large. At this time, control the first air deflector 202 to rotate to the left side by a larger first preset angle, and control the wind wheel 300 in the first zone to rotate at second rotational speed. It can also control the second blade 308 of the wind wheel 300 in the first zone to move to the second operative position at the same time, send more cold air to the left room with a larger air volume, and enhance the cooling effect to the left side of the room with a larger force.

If the temperature difference range is within the range of the second difference value, it means that the temperature difference is small. At this time, control the first air deflector 202 to rotate to the left side by a smaller second preset angle, and control the wind wheel 300 in the first zone to rotate at the first rotational speed. The second blade 308 of the wind wheel 300 in the first zone also can be controlled to move to the first operative position at the same time, send more cold air to the left room with a smaller air volume, and increase the cooling effect to the left side of the room with a smaller force.

When the difference value between the first ambient temperature and the second ambient temperature is a positive value, it means that the temperature on the left side of the room is higher than the temperature on the right side, and the temperature difference range is further acquired at this time. If the temperature difference range is within the range of the first difference value, it means that the temperature difference is large. At this time, the first air deflector 202 is controlled to rotate to the right side by a larger first preset angle, and the wind wheel 300 in the second zone rotates at the second rotational speed. It can also control the second blade 308 of the wind wheel 300 in the second zone to move to the second operative position, to send more cold air to the right room with a larger air volume, and enhance the cooling effect to the right side of the room with a larger force.

If the temperature difference is within the range of second difference value, it means that the temperature difference is small. At this time, control the first air deflector 202 to rotate to the right side by a smaller second preset angle, and control the wind wheel 300 in the second zone to rotate at first rotational speed. It can also control the second blade 308 of the wind wheel 300 in the second zone to move to the first operative position at the same time, to send more cold air to the right room with a smaller air volume, and enhance the cooling effect to the right side of the room with a smaller force.

When the absolute values of the first ambient temperature and the third ambient temperature are within the third preset difference value range. It can be considered that the temperature in the room is uniform from left to right; control the first air deflector 202 to swing to the initial position, and the air is normally supplied to the front of the room.

As shown in FIG. 1, FIG. 2 and FIG. 3, in one embodiment of the present disclosure, the air conditioner further comprises a second air deflector 204, rotatably connected to the air conditioner body 100, and configured to open or close the air outlet 102, and the second air deflector 204 is provided with a through hole for air flow to pass through, the second air deflector 204 and the air diffusing assembly 206 are assembled to define an angle-shaped cavity located outside the air outlet 102 of the air conditioner and communicated with the air outlet 102 of the air conditioner, and both ends of the cavity along a length direction of a splicing line of the second air deflector 204 and the air diffusing assembly 206 are respectively formed with a side opening, and the side opening communicates with the cavity.

The air conditioner body 100 comprises a casing, the casing has a front side wall, a lower side wall, a left end cover and a right end cover, and a transition position between the front side wall of the casing and the lower side wall of the casing is formed with the air outlet 102; the first side of the air outlet 102 is close to the left end cover, and the second side of the air outlet is close to the right end cover.

In this embodiment, the casing comprises a front side wall and a lower side wall, corresponding to the front (front direction) and bottom (bottom direction) of the air conditioner, and the air outlet 102 faces the "front and lower" side of the air conditioner. The casing also comprises a left end cover and a right end cover, corresponding to the left and right sides of the air conditioner, respectively. The first side of the air outlet 102 is close to the right end cover, and the second side of the air outlet 102 is close to the left end cover. That is, the first side is the right half of the air outlet, and the second side is the left half of the air outlet. By adjusting the first air deflector to face the left half or the right half, "left and right windless feeling" can be achieved and user experience can be improved.

In some embodiments, the left end cover and the right end cover are respectively provided with side air outlets for lateral air intake.

The second air deflector 204 is used to open or close the air outlet 102. When the air conditioner is turned off, the second air deflector 204 covers the air guide outlet. After the air conditioner is turned on, the second air deflector 204 rotates relative to the air conditioner body 100 and opens the air outlet 102. At the same time, the second air deflector 204 is provided with a plurality of through holes, and the air flow will be broken up into multiple staggered small air flows after passing through the through holes.

After the second air deflector 204 is assembled with the air diffusing assembly 206, a cavity is formed outside the air outlet 102, and side openings are formed on both sides of the cavity, thereby realizing air supply on both sides. In some embodiments, a side fan may also be provided at the side opening to ensure the air supply volume of the side air supply.

In one embodiment of the present disclosure, the user turns on the power and selects the cooling mode to run, and the air output assembly operates at the cooling angle. After receiving the windless feeling function signal, the air output assembly swings from the cooling angle to the windless feeling default angle, and the first blade and the second blade in the wind wheel are in staggered positions. If the body windless feeling signal is received at this time, or the user's position information is detected, the user's position information can be acquired directly through infrared, or through the positioning information on the smart device carried by the user, taking the person on the left as an example:

Control all swirl blades corresponding to the right side from the staggered position to the overlapping position, the vertical air deflector swings from the middle position to the right position. At this time, the cold air is mainly sent out by the swirl blade on the right side, and the left side is in the windless feeling state.

Or control all the swirl blades corresponding to the right side to rotate, play the role of induced draft fan, and control the vertical air deflector to swing from the middle position to the right position.

The control sequence of human actions from right to left, taking the wind wheel set with eight blades as an example, the four blades on the left are in the overlapping position, the two on the left are in the overlapping position, the four in the middle are in the overlapping position, the two on the right are in the overlapping position, and finally the four on the right are in the overlapping position. The deflection angle of the vertical air deflector is from left 45° to left 30°, then to left 15°, then to left 0°, and then successively transitions to right 0°, right 15°, right 30°, and right 45°.

If there is no windless feeling signal, judge the temperature difference value Tc of the left and right areas of the room, and take the right side difference value as an example, if $5 \geq Tc \geq 2$, control all swirl blades corresponding to the right side to rotate at high speed, or completely overlap the position, and the vertical air deflector is all biased to the right side by 35° to 55°.

If $2 > Tc \geq 1$, control all the corresponding swirl blades to rotate at a low speed, or in a semi-coincident position, with the vertical air deflector biased to the right side area by 15° to 30°. In order to meet the demand of cooling on the right side, if the temperature difference value $Tc < 1$, control the air deflector components to swing to the windless feeling default angle.

According to the user's usage habits, the present disclosure enters the left or right wind angle by default when the device is turned on next time.

In some embodiments, due to the overall decrease in the heat exchange capacity of the system in the windless feeling mode, the cooling capacity is concentrated on the indoor heat exchanger and cannot be fully discharged. The air conditioner can be controlled to increase downward (in the direction of the ground) to increase the wind volume, and use the downward flow trend of the cooling volume to improve the cooling efficiency and system performance.

In some cases, the windless feeling mode may cause a circulation near the air conditioner due to the positive pressure at the air outlet and the negative pressure at the return air outlet, resulting in a decrease in the overall wind volume, worsening of the overall circulation of the room, and the user feeling "stuffy".

In order to solve the above-mentioned problems, differential air supply can be used, for example, a part of the air supply adopts a large air volume, and the other part of the air supply adopts a mode of small air volume, which promotes the air exchange between the far and near positions of the room.

Figure 6:
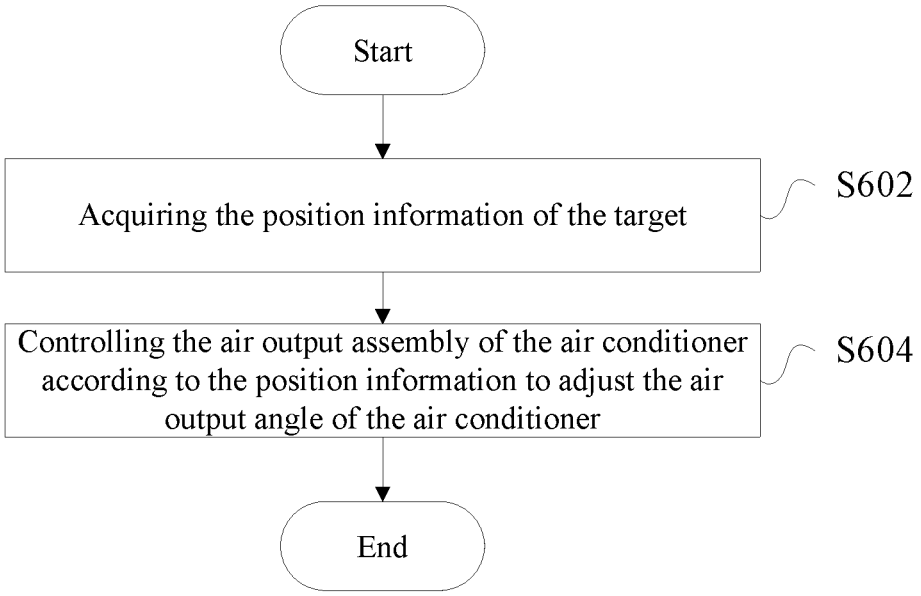
FIG. 6 shows a flow chart of an air conditioner control method according to an embodiment of the present disclosure.

In one embodiment of the present disclosure, as shown in FIG. 6, a control method for an air conditioner is provided, comprising:

Step S602, acquiring the position information of the target.

Step S604, controlling the air output assembly of the air conditioner according to the position information to adjust the air output angle of the air conditioner.

The air output assembly comprises an air diffusing assembly and a first air deflector, the control method also comprises: receiving, a control instruction, and controlling the air diffusing assembly to shield the air outlet according to the control instruction, and controlling the first air deflector to swing to an initial position.

In this embodiment, the air conditioner comprises an air output assembly, and the air output assembly can adjust the air output angle.

The position information of the target is detected, and the target may be a human body or a preset object, such as "bed", "desk", "sofa" and other furniture where the human body may stay. By controlling the air output assembly to adjust the air output angle according to the position information of the target, so that the direction of the "target" is in a windless feeling state, thereby ensuring that the air supply will not "blow directly" on the human body and improve the comfort of the air conditioner. At the same time, at angles other than the direction of the target, the air supply volume is increased by means of "direct blowing", thereby improving the cooling efficiency under the premise of ensuring that the human body has no need for wind, thereby meeting the various needs of users.

After the air conditioner is turned on, it runs in the normal cooling or normal heating mode by default, and the windless feeling mode is not activated at this time. When the air conditioner receives the corresponding control instruction through the communication interface, the windless feeling control instruction, the air conditioner enters the default windless feeling state, and controls the air diffusing assembly to shield the air outlet, and controls the first air deflector to swing to the initial position. At this time, the whole room is in a windless feeling state, which ensures that the human body will not be "directly blown" by the cold wind of the air conditioner to the greatest extent.

Figure 7:
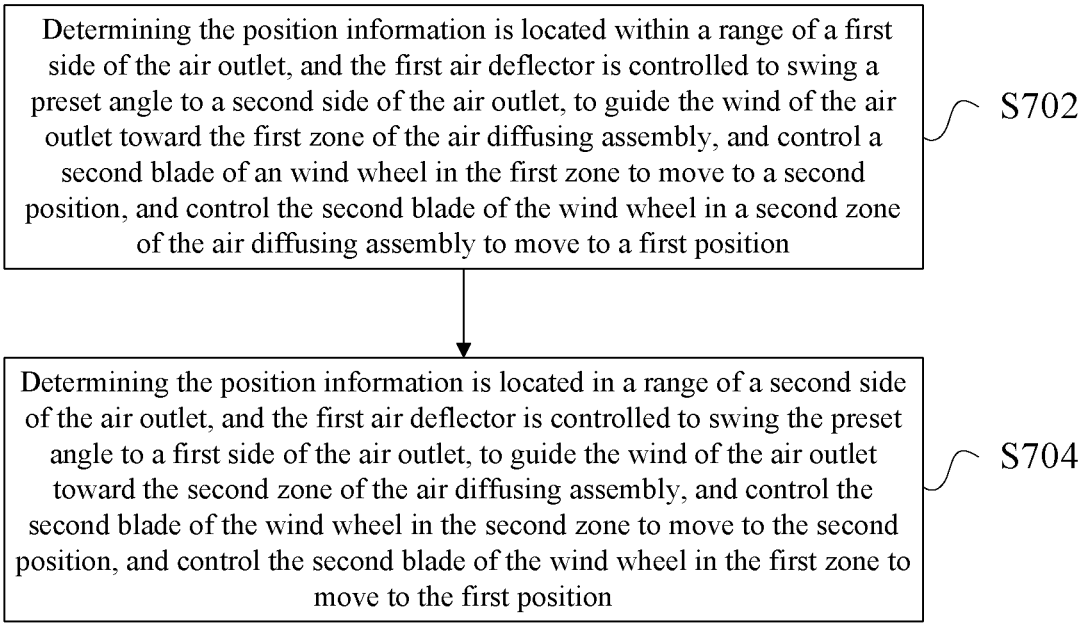
FIG. 7 shows another flow chart of the air conditioner control method.

As shown in FIG. 7, in one embodiment of the present disclosure, the step of determining position information is acquired, and the controller controls the air output assembly according to the position information can comprise:

Step S702, determining the position information is located within a range of a first side of the air outlet, and the first air deflector is controlled to swing a preset angle to a second side of the air outlet, to guide the wind of the air outlet toward the first zone of the air diffusing assembly, and control a second blade of an wind wheel in the first zone to move to a second operative position, and control the second blade of the wind wheel in a second zone of the air diffusing assembly to move to a first operative position;

Step S704, determining the position information is located within a range of a second side of the air outlet, and the first air deflector is controlled to swing the preset angle to a first side of the air outlet, to guide the wind of the air outlet toward the second zone of the air diffusing assembly, and control the second blade of the wind wheel in the second zone to move to the second operative position, and control the second blade of the wind wheel in the first zone to move to the first operative position.

The air conditioner control method further comprises:

Determining the position information is located within a range of a first side of the air outlet, and controlling the wind wheel in the first zone to run at a first rotational speed, and at the same time, controls the wind wheel in the second zone to run at a second rotational speed; and Determining, the position information is located within a range of a second side of the air outlet, and controlling the wind wheel in the second zone to run at the first rotational speed, and at the same time, controls the wind wheel in the first zone to run at the second rotational speed.

The second rotational speed is greater than the first rotational speed.

In this embodiment, when the position information is located in the range of the first side of the air outlet, control the first air deflector to swing to the second side of the air outlet, to avoid the wind blowing in the direction of the target. And control the blade in the first zone to rotate to the second operative position to increase the intensity of the windless feeling mode. At the same time, control the second blade of the wind wheel in the second zone to move to the first operative position, that is, to the second zone, that is, increase the air supply volume on one side where the target is not located to improve the cooling effect.

Similarly, when the position information is located in the range of the second side of the air outlet, control the first air deflector to swing to the first side of the air outlet to avoid the wind blowing to the direction of the target. And control the blade in the second zone to rotate to the second operative position to increase the intensity of the windless feeling mode. At the same time, control the second blade of the wind wheel in the first zone to move to the first operative position, that is, to the first zone, that is, increase the air supply volume on one side where the target is not located to improve the cooling effect.

According to the position information, correspondingly control the operation of the wind wheel of the first zone and the second zone on the air diffusing assembly. The wind rotor facing the area where the target is located is controlled to run at the first rotational speed, and the wind wheel facing the area where the non-target is located is controlled to rotate at the second rotational speed. The first rotational speed is lower than the second rotational speed, that is, the wind speed of the air supply to the direction of the human body is controlled to be low, and the wind speed of the air supply to the direction of the human body is not correspondingly increased. On the basis of ensuring that the air supply will not "blow directly" on the human body and ensure the effect of windless feeling, the cooling effect is improved by increasing the air supply volume in the direction that does not blow directly on the human body to meet the cooling demand.

Figure 8:
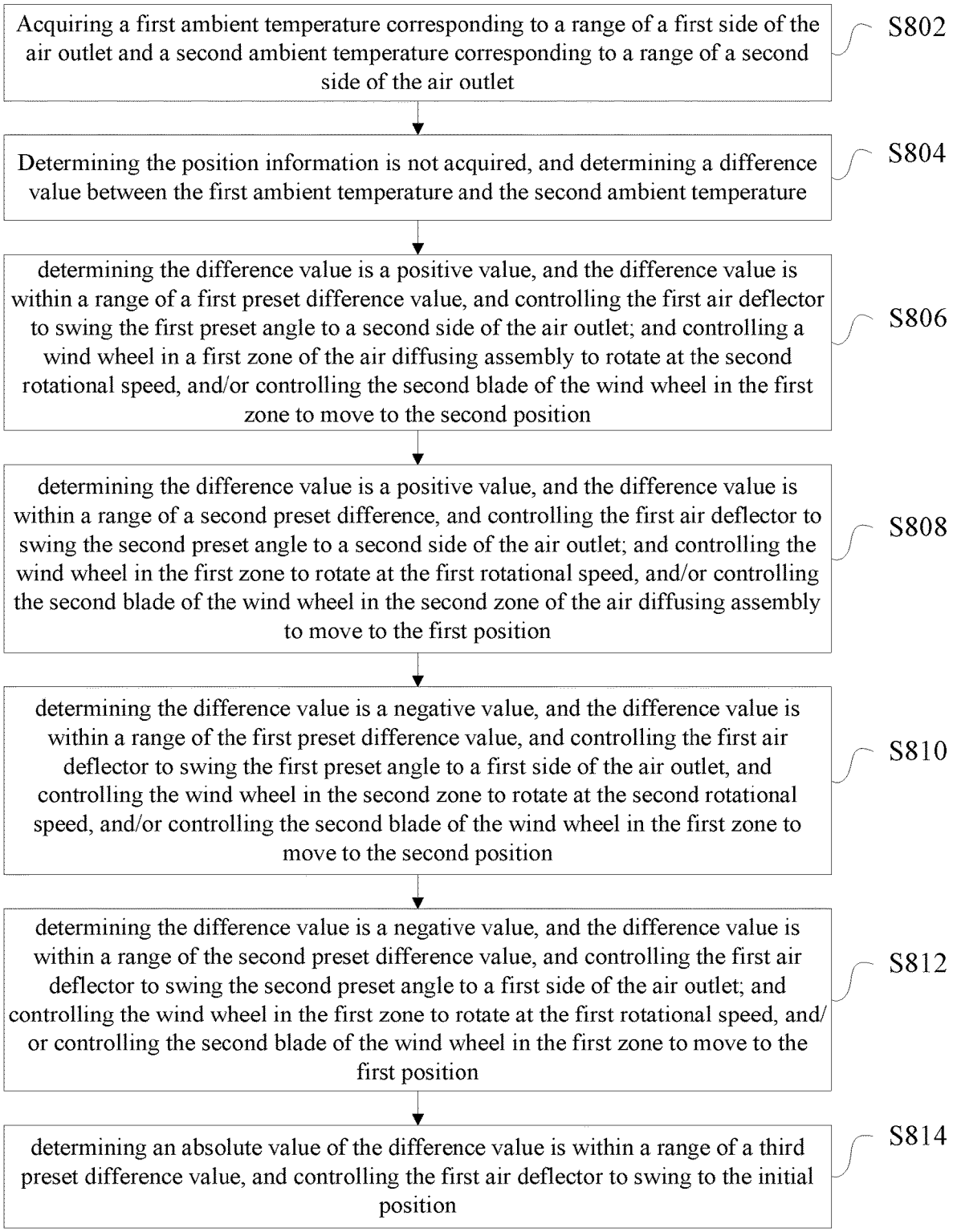
FIG. 8 shows yet another flow chart of the air conditioner control method.

As shown in FIG. 8, in one embodiment of the present disclosure, the preset angle comprises a first preset angle and a second preset angle, the control method further comprising:

Step S802, acquiring a first ambient temperature corresponding to a range of a first side of the air outlet and a second ambient temperature corresponding to a range of a second side of the air outlet;

Step S804, determining the position information is not acquired, and determining a difference value between the first ambient temperature and the second ambient temperature;

Step S806, determining the difference value is a positive value, and the difference value is within a range of a first preset difference value, and controlling the first air deflector to swing the first preset angle to a second side of the air outlet; and controlling a wind wheel in a first zone of the air diffusing assembly to rotate at the second rotational speed, and/or controlling the second blade of the wind wheel in the first zone to move to the second operative position;

Step S808, determining the difference value is a positive value, and the difference value is within a range of a second preset difference, and controlling the first air deflector to swing the second preset angle to a second side of the air outlet; and controlling the wind wheel in the first zone to rotate at the first rotational speed, and/or controlling the second blade of the wind wheel in the second zone of the air diffusing assembly to move to the first operative position;

Step S810, determining the difference value is a negative value, and the difference value is within a range of the first preset difference value, and controlling the first air deflector to swing the first preset angle to a first side of the air outlet, and controlling the wind wheel in the second zone to rotate at the second rotational speed, and/or controlling the second blade of the wind wheel in the first zone to move to the second operative position;

Step S812, determining the difference value is a negative value, and the difference value is within a range of the second preset difference value, and controlling the first air deflector to swing the second preset angle to a first side of the air outlet; and controlling the wind wheel in the first zone to rotate at the first rotational speed, and/or controlling the second blade of the wind wheel in the first zone to move to the first operative position;

Step S814, determining an absolute value of the difference value is within a range of a third preset difference value, and controlling the first air deflector to swing to the initial position.

In this embodiment, when the target is not acquired, such as the position information of the human body, according to the first ambient temperature and the second ambient temperature, that is, the temperature difference between the ambient temperature on the left side toward which the air conditioner faces and the ambient temperature on the right side toward which the air conditioner faces controls the air output assembly to change the air output direction.

The difference value of the first ambient temperature and the second ambient temperature is a positive value, it means that the left and right temperatures in the room are uneven, and the temperature on the left side is higher than the temperature on the right side. At this time, the temperature difference range is further acquired. If the temperature difference range is within the range of the first difference value, it means that the temperature difference is large. At this time, control the first air deflector to rotate to the left side by a larger first preset angle, and control the wind wheel in the first zone to rotate at second rotational speed. It can also control the second blade of the wind wheel in the first zone to move to the second operative position at the same time, send more cold air to the left room with a larger air volume, and enhance the cooling effect to the left side of the room with a larger force.

If the temperature difference range is within the range of the second difference value, it means that the temperature difference is small. At this time, control the first air deflector to rotate to the left side by a smaller second preset angle, and control the wind wheel in the first zone to rotate at the first rotational speed. The second blade of the wind wheel in the first zone also can be controlled to move to the first operative position at the same time, send more cold air to the left room with a smaller air volume, and increase the cooling effect to the left side of the room with a smaller force.

When the difference value between the first ambient temperature and the second ambient temperature is a positive value, it means that the temperature on the left side of the room is higher than the temperature on the right side, and the temperature difference range is further acquired at this time. If the temperature difference range is within the range of the first difference value, it means that the temperature difference is large. At this time, the first air deflector is controlled to rotate to the right side by a larger first preset angle, and the wind wheel in the second zone rotates at the second rotational speed. It can also control the second blade of the wind wheel in the second zone to move to the second operative position, to send more cold air to the right room with a larger air volume, and enhance the cooling effect to the right side of the room with a larger force.

If the temperature difference is within the range of second difference value, it means that the temperature difference is small. At this time, control the first air deflector to rotate to the right side by a smaller second preset angle, and control the wind wheel in the second zone to rotate at first rotational speed. It can also control the second blade of the wind wheel in the second zone to move to the first operative position at the same time, to send more cold air to the right room with a smaller air volume, and enhance the cooling effect to the right side of the room with a smaller force.

When the absolute values of the first ambient temperature and the third ambient temperature are within the third preset difference value range. It can be considered that the temperature in the room is uniform from left to right, control the first air deflector to swing to the initial position, and the air is normally supplied to the front of the room.

A range of the first preset difference value is less than or equal to 5 and greater than or equal to 2, a range of the second preset difference value is less than or equal to 2 and greater than or equal to 1, a range of the third preset difference value is greater than or equal to 0 and less than 1.

It can be understood that the first preset difference value range, the second preset difference value range and the third preset difference value range can be adjusted correspondingly according to the specific environmental conditions or the installation of the air conditioner and the actual needs of users. The preset ranges in the embodiments of the present disclosure are not limited to the above-mentioned numerical ranges.

Figure 9:
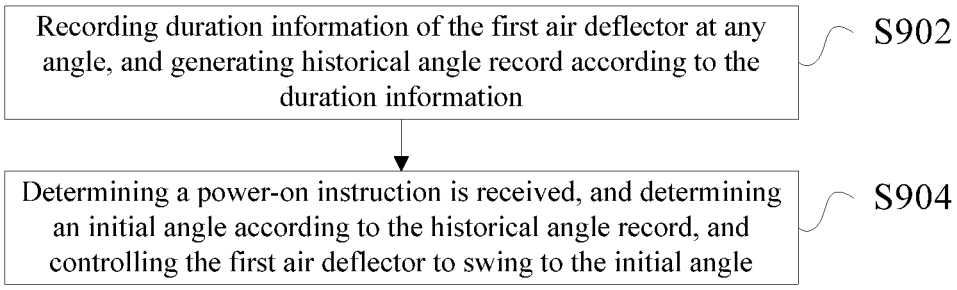
FIG. 9 shows yet another flow chart of the air conditioner control method.

As shown in FIG. 9, in one embodiment of the present disclosure, the air conditioner control method further comprises:

Step S902, recording duration information of the first air deflector at any angle, and generating historical angle record according to the duration information; and Step S904, determining a power-on instruction is received, and determining an initial angle according to the historical angle record, and controlling the first air deflector to swing to the initial angle.

In this embodiment, the duration information of the first air deflector at different angles is recorded, and a historical angle record is generated. According to the historical angle record, the angle data most frequently used by the user can be acquired. When the air conditioner is turned on again, the angle with the longest use time by the user is taken as the initial angle by default, and the first air deflector is controlled to work at the initial angle, which can ensure that the wind mode of the air conditioner matches the user's usage habits to the greatest extent, and improve the user experience.

Figure 10:
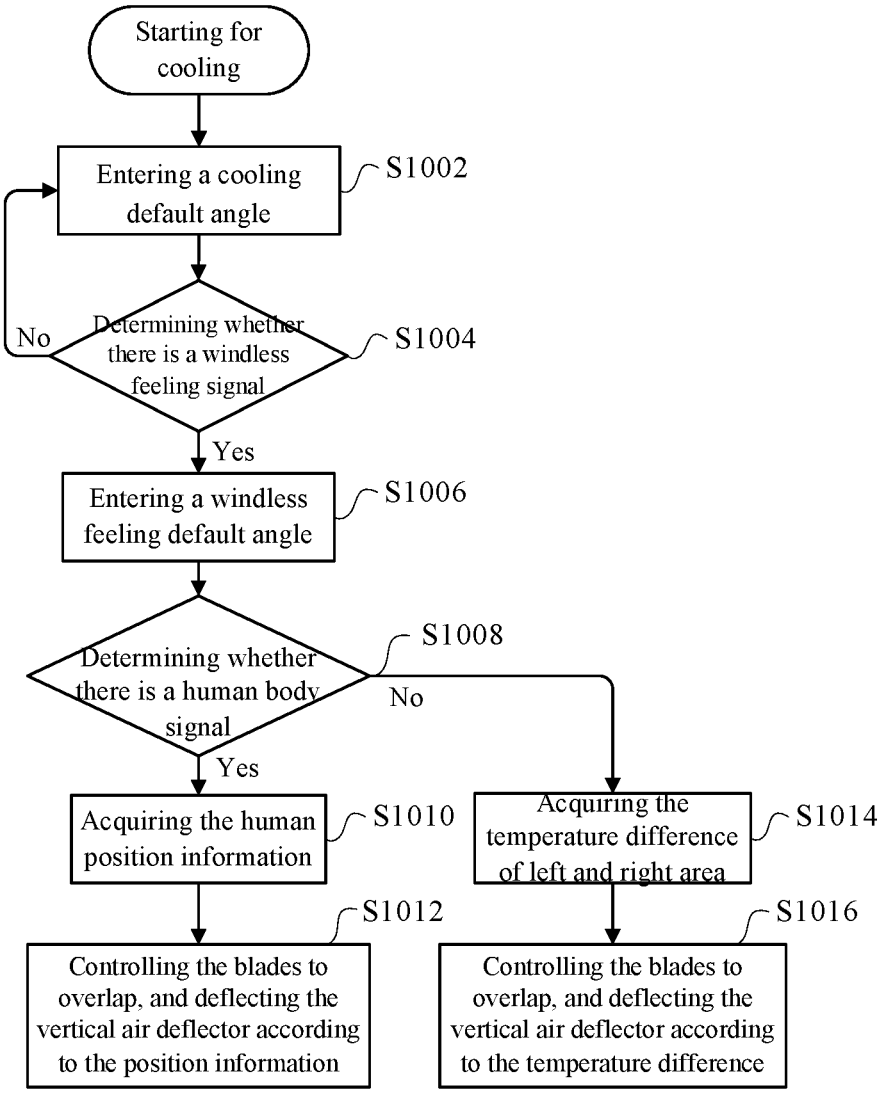
FIG. 10 shows yet another flow chart of the air conditioner control method.
Figure 11:
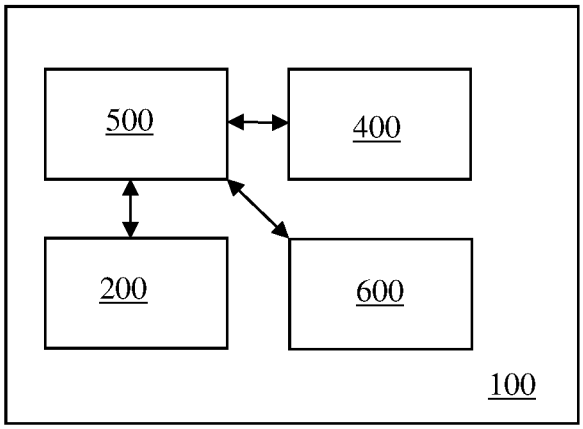
FIG. 11 is a schematic block view of the air conditioner.

In one embodiment of the present disclosure, the overall logic of windless feeling control is shown in FIG. 10:

After starting for cooling, performing Step S100 to enter a cooling default angle;

Step S1004, determining whether there is a windless feeling signal; if yes, proceeding to Step S1006, otherwise, returning to Step S1002;

Step S1006, entering the windless feeling default angle;

Step S1008, determining whether there is a human body signal; if yes, proceeding to Step S1010, otherwise, proceeding to Step S1014;

Step S1010, acquiring the human position information;

Step S1012, controlling the blades to overlap, and deflecting the vertical air deflector according to the position information;

Step S1014, acquiring the temperature difference of left and right area;

Step S1016, controlling the blades to overlap, and deflecting the vertical air deflector according to the temperature difference.

One embodiment of the present disclosure provides a computer-readable storage medium on which a computer program is stored, and when the computer program is executed by a processor, implements the air conditioner control method provided in any of the above-mentioned embodiment. Therefore, the computer-readable storage medium comprises all the beneficial effects of the air conditioner control method provided in any of the above-mentioned embodiments, and will not be repeated here.

In the description of the present disclosure, the term "multiple" refers to two or more, unless otherwise clearly defined, and it should be understood that the orientation or position relationships indicated by the terms "upper", "lower" and the like are the orientation or position relationships based on what is shown in the drawings, are merely for the convenience of describing the present disclosure and simplifying the description, and do not indicate or imply that the device or unit referred to must have a particular direction and is constructed and operated in a specific orientation, and thus cannot be understood as the limitation of the present disclosure. The terms "connected", "installed", "fixed", etc. should be understood in a broad sense. For example, "connected" can be a fixed connection, a detachable connection, or an integral connection; it can be directly connected, or indirectly connected through an intermediate connection. For those of ordinary skill in the art, the specific meanings of the above terms in the present invention can be understood according to specific situations.

In the description of the present specification, the descriptions of the terms "one embodiment", "some embodiments" and "specific embodiments" and the like mean that specific features, structures, materials or characteristics described in conjunction with the embodiment(s) or example(s) are comprised in at least one embodiment or example of the present disclosure. In the specification, the schematic representation of the above terms does not necessarily refer to the same embodiment or example. Moreover, the specific features, structures, materials or characteristics described may be combined in a suitable manner in any one or more embodiments or examples.

The descriptions above are only preferred embodiments of the present disclosure, which are not used to limit the present disclosure. For a person skilled in the art, the present disclosure may have various changes and variations. Any modifications, equivalent substitutions, improvements etc. within the spirit and principle of the present disclosure shall all be comprised in the protection scope of the present disclosure.

What is claimed is:

1. An air conditioner comprising:

an air conditioner body comprising an air outlet and an air output assembly, wherein the air output assembly is arranged at the air outlet and configured to adjust an air output angle of the air outlet;

a detection device configured to acquire position information of a target; and a controller electrically connected to the air output assembly and the detection device and configured to control the air output assembly according to the position information, wherein the air output assembly comprises:

a first air deflector arranged inside the air outlet and configured to swing relative to an orientation of the air outlet to change the air output angle of the air outlet; and an air diffusing assembly connected to the air conditioner body and configured to move relative to the air conditioner body to shield or open the air outlet, wherein the air diffusing assembly is formed with an air diffusing structure, and the air diffusing structure is configured to allow an air flow to pass through and diffusing the passing air flow, and wherein the air diffusing structure defines a first zone and a second zone, and the air diffusing structure comprises:

a plurality of wind wheels, wherein the plurality of the wind wheels are arranged and distributed in the first zone and the second zone respectively along a length direction of the air diffusing structure, the wind wheels in the first zone are meshed and driven by a gear structure, and the wind wheels in the second zone are meshed and driven by a gear structure.

2. The air conditioner according to claim 1, wherein each wind wheel comprises:

an inner rib and an outer ring rib; and at least one first blade and at least one second blade arranged between the inner rib and the outer ring rib, wherein the at least one first blade is fixedly connected to the inner rib and the outer ring rib, and the at least one second blade is rotationally connected to the inner rib and has a first operative position and a second operative position, and wherein when the at least one second blade is in the first operative position, the at least one second blade is arranged at intervals with the at least one first blade, and when the at least one second blade is in the second operative position, the at least one second blade overlaps the at least one first blade in an axial direction of said each wind wheel.

3. The air conditioner according to claim 2, wherein:

the outer ring rib is provided with a positioning portion protruding toward the inner rib; and the at least one second blade is provided with a convex rib corresponding to the positioning portion, and when the at least one second blade moves to the first operative position, the positioning portion abuts against the convex rib to limit the second blade.

4. The air conditioner according to claim 3, further comprising:

a communication interface connected to the controller and configured to receive a control instruction, wherein the controller controls the air diffusing assembly to shield the air outlet according to the control instruction, and controls the first air deflector to swing to an initial position.

5. The air conditioner according to claim 4, wherein after the position information is acquired, to control the air output assembly according to the position information, the controller is configured to:

determine that the position information is located within a range of a first side of the air outlet, control the first air deflector to swing a preset angle to a second side of the air outlet to guide the air of the air outlet toward the first zone of the air diffusing assembly, control second blades of the wind wheels in the first zone to move to the second operative position, and control second blades of the wind wheels in the second zone to move to the first operative position; and determine that the position information is located within a range of a second side of the air outlet, control the first air deflector to swing the preset angle to the first side of the air outlet to guide the air of the air outlet toward the second zone of the air diffusing assembly, control the second blades of the wind wheels in the second zone to move to the second operative position, and control the second blades of the wind wheels in the first zone to move to the first operative position.

6. The air conditioner according to claim 5, wherein:

the air conditioner body comprises a casing; the casing comprises a front side wall, a lower side wall, a left end cover and a right end cover; and a transition position between the front side wall and the lower side wall is formed with the air outlet; and the first side of the air outlet is close to the right end cover, and the second side of the air outlet is close to the left end cover.

7. The air conditioner according to claim 5, wherein the controller is further configured to:

control the wind wheels in the first zone to run or stand still at a first rotational speed and simultaneously control the wind wheels in the second zone to run at a second rotational speed, when the position information is determined within the range of the first side of the air outlet; and control the wind wheels in the second zone to run or stand still at the first rotational speed and simultaneously control the wind wheels in the first zone to run at the second rotational speed, when the position information is determined within the range of the second side of the air outlet, wherein the second rotational speed is greater than the first rotational speed.

8. The air conditioner according to claim 7, wherein:

the preset angle comprises a first preset angle and a second preset angle, and the detection device is configured to acquire a first ambient temperature corresponding to the range of the first side of the air outlet and a second ambient temperature corresponding to the range of the second side of the air outlet;

when the position information is not acquired, the controller is configured to determine a difference value between the first ambient temperature and the second ambient temperature;

when the difference value is a positive value and the difference value is within a range of a first preset difference value, the controller is configured to:

control the first air deflector to swing the first preset angle to a second side of the air outlet; and control the wind wheels in the first zone to rotate at the second rotational speed, and/or the second blades of the wind wheels in the first zone to move to the second operative position; and when the difference value is a positive value and the difference value is within a range of a second preset difference value, the controller is configured to:

control the first air deflector to swing the second preset angle to a second side of the air outlet; and control the wind wheels in the first zone to rotate at the first rotational speed, and/or control the second blades of the wind wheels in the second zone to move to the first operative position.

9. The air conditioner according to claim 8, wherein:

when the difference value is a negative value and the difference value is within the range of the first preset difference value, the controller is configured to:

control the first air deflector to swing the first preset angle to the first side of the air outlet; and control the wind wheels in the second zone to rotate at the second rotational speed, and/or control the second blades of the wind wheels in the first zone to move to the second operative position;

when the difference value is a negative value and the difference value is within the range of the second preset difference value, the controller is configured to:

control the first air deflector to swing the second preset angle to a first side of the air outlet; and control the wind wheels in the first zone to rotate at the first rotational speed, and/or control the second blades of the wind wheels in the first zone to move to the first operative position; and when an absolute value of the difference value is within a range of a third preset difference value, the controller is configured to control the first air deflector to swing to the initial position.

10. The air conditioner according to claim 1, further comprising:

a second air deflector rotatably connected to the air conditioner body and configured to open or close the air outlet, and the second air deflector is provided with a through hole for air flow to pass through, wherein:

the second air deflector and the air diffusing assembly are assembled to define an angle-shaped cavity located outside the air outlet of the air conditioner and communicated with the air outlet of the air conditioner;

both ends of the angle-shaped cavity along a length direction of a splicing line of the second air deflector and the air diffusing assembly are respectively formed with a side opening; and the side opening communicates with the angle-shaped cavity.

11. An air conditioner control method, for controlling the air conditioner according to claim 1, wherein the air conditioner control method comprises:

acquiring position information of a target; and controlling the air output assembly of the air conditioner according to the position information to adjust the air output angle of the air outlet of the air conditioner.

12. The air conditioner control method according to claim 11, wherein the air output assembly comprises an air diffusing assembly and a first air deflector, the air conditioner control method further comprises:

receiving a control instruction; and controlling the air diffusing assembly to shield the air outlet according to the control instruction, and controlling the first air deflector to swing to an initial position.

13. The air conditioner control method according to claim 12, wherein the controlling the air output assembly of the air conditioner according to the position information comprises:

determining the position information is located within a range of a first side of the air outlet, controlling the first air deflector to swing a preset angle to a second side of the air outlet to guide the air of the air outlet toward the first zone of the air diffusing assembly, controlling a second blade of an wind wheel in the first zone to move to a second operative position, and controlling the second blade of the wind wheel in a second zone of the air diffusing assembly to move to a first operative position; and determining the position information is located within a range of a second side of the air outlet, controlling the first air deflector to swing the preset angle to a first side of the air outlet to guide the air of the air outlet toward the second zone of the air diffusing assembly, controlling the second blade of the wind wheel in the second zone to move to the second operative position, and controlling the second blade of the wind wheel in the first zone to move to the first operative position.

14. The air conditioner control method according to claim 13, further comprising:

determining the position information is located within a range of a first side of the air outlet, controlling the wind wheel in the first zone to run at a first rotational speed and simultaneously controlling the wind wheel in the second zone to run at a second rotational speed; and determining the position information is located within a range of a second side of the air outlet, controlling the wind wheel in the second zone to run at the first rotational speed and simultaneously controlling the wind wheel in the first zone to run at the second rotational speed, wherein the second rotational speed is greater than the first rotational speed.

15. The air conditioner control method according to claim 14, wherein the preset angle comprises a first preset angle and a second preset angle, the air conditioner control method further comprises:

acquiring a first ambient temperature corresponding to a range of a first side of the air outlet and a second ambient temperature corresponding to a range of a second side of the air outlet;

determining the position information is not acquired, and determining a difference value between the first ambient temperature and the second ambient temperature;

determining the difference value is a positive value, and the difference value is within a range of a first preset difference value, and controlling the first air deflector to swing the first preset angle to a second side of the air outlet;

controlling a wind wheel in a first zone of the air diffusing assembly to rotate at the second rotational speed, and/or controlling the second blade of the wind wheel in the first zone to move to the second operative position;

determining the difference value is a positive value, and the difference value is within a range of a second preset difference value, and controlling the first air deflector to swing the second preset angle to a second side of the air outlet;

controlling the wind wheel in the first zone to rotate at the first rotational speed, and/or controlling the second blade of the wind wheel in the second zone of the air diffusing assembly to move to the first operative position;

determining the difference value is a negative value, and the difference value is within a range of the first preset difference value, and controlling the first air deflector to swing the first preset angle to a first side of the air outlet;

controlling the wind wheel in the second zone to rotate at the second rotational speed, and/or controlling the second blade of the wind wheel in the first zone to move to the second operative position;

determining the difference value is a negative value, and the difference value is within a range of the second preset difference value, and controlling the first air deflector to swing the second preset angle to a first side of the air outlet;

controlling the wind wheel in the first zone to rotate at the first rotational speed, and/or controlling the second blade of the wind wheel in the first zone to move to the first operative position; and determining an absolute value of the difference value is within a range of a third preset difference value, and controlling the first air deflector to swing to the initial position.

16. The air conditioner control method according to claim 15, wherein:

a range of the first preset difference value is less than or equal to 5 and greater than or equal to 2;

a range of the second preset difference value is less than or equal to 2 and greater than or equal to 1; and a range of the third preset difference value is greater than or equal to 0 and less than 1.

17. The air conditioner control method according to claim 11, further comprising:

recording duration information of the first air deflector at any angle, and generating historical angle record according to the duration information; and determining that a power-on instruction is received, and determining an initial angle according to the historical angle record, and controlling the first air deflector to swing to the initial angle.

18. A non-transitory computer-readable storage medium on which a computer program is stored, wherein when the computer program is executed by a processor, the air conditioner control method according to claim 11 is implemented.

* * * * *